US007052362B2

(12) United States Patent
Lynn

(10) Patent No.: US 7,052,362 B2
(45) Date of Patent: May 30, 2006

(54) BLENDABLE BLASTING MEDIA AND METHOD OF REUSING AND DISCHARGING SAME

(76) Inventor: William R. Lynn, 3A 26 Ave., Isle of Palms, SC (US) 29451

( * ) Notice: Subject to any disclaimer, the term of this patent is extended or adjusted under 35 U.S.C. 154(b) by 0 days.

(21) Appl. No.: 10/979,077

(22) Filed: Oct. 29, 2004

(65) Prior Publication Data

US 2005/0107005 A1 May 19, 2005

Related U.S. Application Data

(60) Provisional application No. 60/515,347, filed on Oct. 29, 2003.

(51) Int. Cl.
*B24C 3/00* (2006.01)

(52) U.S. Cl. ..... 451/3; 451/2; 451/38; 451/100; 451/36

(58) Field of Classification Search ..... 451/37, 451/38, 36, 3, 2, 100, 102
See application file for complete search history.

(56) References Cited

U.S. PATENT DOCUMENTS 4,771,580 A * 9/1988 Male ..... 451/102
5,334,019 A * 8/1994 Goldsmith et al. ..... 433/88
5,562,531 A * 10/1996 Yamaharu ..... 451/88
5,591,064 A * 1/1997 Spears, Jr. ..... 451/2
5,823,860 A 10/1998 Lynn et al.
6,000,995 A * 12/1999 Ruholl ..... 451/2

* cited by examiner

*Primary Examiner*—George Nguyen
(74) *Attorney, Agent, or Firm*—David & Bujold, P.L.L.C.

(57) ABSTRACT

An apparatus and method for applying a blasting media, comprised of at least first and second separate types of particles, to a surface to be treated. Each type of particle may comprise a core coated with a desired component, e.g. abrasive, absorptive, polishing, etc., and the components are selected so as to minimize the density variation of different types of media being combined with one another for the surface treatment. The different types of particles are mixed with one another prior to application to a surface to be treated. The mixing may occur in a mixing tank prior to use, in the media supply conduit prior to the nozzle, at the discharge outlet of the nozzle, or just prior to contacting the surface to be treated. By employing different types of particles, cleaning and reuse of the media is facilitated while also minimizing the amount of media consumed per unit area of wall to be treated. In addition, an operator is able to custom blend the media, during use at a jobsite, to maximize surface treatment, per pound of media, and minimize the generation of disposable waste.

4 Claims, 7 Drawing Sheets

BLENDABLE BLASTING MEDIA AND METHOD OF REUSING AND DISCHARGING SAME

This application claims the benefit of Provisional Application No. 60/515,347, filed Oct. 29, 2003.

FIELD OF THE INVENTION

This invention relates to an improved blasting media, and more particularly to a blasting media comprised of a desired blend of two or more separate types of particles, e.g abrasive, absorptive, carrier, polishing, other surface finishing or treating particles and/or combinations thereof.

BACKGROUND OF THE INVENTION

It is known in the art to apply various substances and materials to a desired surface and to remove contaminants, rust, debris, paint, etc., from a surface by the use of blasting media. The blasting media may consist of a dry or a liquid material or a substantially uniform combination thereof formed as individual unitary particles.

Traditionally during a blasting operation, the media is mixed by using various sized particles of the same kind or type of media, i.e. all of the media particles generally have the same composition. Some blasting media known in the art attempt to combine abrasive components and absorptive components, for example, in the same particle. The resulting particles must be absorptive enough to remove liquids and control dust while, at the same time, be aggressive enough to remove contaminants and debris, e.g. rust, paint, oil, etc., which has adhered to the surface from which it is to be removed.

Using a single kind or type of particle with abrasive and absorptive components incorporated therein leads to the problem of recontamination of the surface being treated once the media absorbs a significant amount of contaminants and is re-used. Another problem is that the abrasive and absorptive properties of the particles are compromised by combining the components' functions in a single particle. In addition, such combination does not allow an operator to customize the media, during use, to take into consideration variations in the amount of contaminants and debris contained on a particular area of the surface to be cleaned and may lead to excessive consumption of the media, e.g. if the media does not contain a great enough abrasive content for the particular surface to be cleaned or a great enough absorptive content, additional media is required to ensure adequate surface treatment.

SUMMARY OF THE INVENTION

Wherefore, it is an object of the present invention to overcome the aforementioned problems and drawbacks associated with the prior art designs.

Another object of the invention is to provide a blasting media having a first type or kind of particles and at least a separate second type or kind of particles which are combined with one another prior to impacting against a surface to be treated.

Yet another object is to provide a system which provides easy separation of the various used blasted particles from one another for cleaning, disposal, recycling, reuse, etc.

Still another object is to employ abrasive particles and absorptive particles, for example, which each have approximately the same weight for particles of about the same size.

Another object is to provide a surface treatment system which facilitates cleaning and reuse of at least the absorptive particles.

A further object of the invention is to provide a surface treatment system which allows custom blending of the media, at a jobsite, to facilitate maximum surface treatment while consuming a minimum amount of blasting media during use.

The present invention relates to a blasting media system comprises at least first and second types of different blasting particles, said system comprising: a) a first container containing a supply of at least said first type of blasting particles; b) a first supply conduit having a first end and a second end, said second end facilitating discharge of at least said first type of blasting particles against a surface to be treated for providing the desired surface treatment thereof; c) a first metering device for metering at least said first type of blasting particles from said container into said first end of said supply conduit; and d) a first device for pressurizing said first end of said supply conduit with a pressurized fluid whereby said pressurized fluid and at least said first type of blasting particles mix with one another in said supply conduit to form a pressurized mixture thereof; wherein said second type of blasting particles is mixed with said first type of blasting particles and said pressurized fluid, prior to the first and second particles contacting the surface to be treated, whereby the first and second mixed particles comprise two separate types of blasting particles which facilitates the desired surface treatment of the surface to be treated and reuse of the media.

The present invention also relates to a method of supplying blasting media comprising at least first and second types of different blasting particles to a surface to be treated, said method comprising the steps of: a) containing a supply of at least said first type of blasting particles in a first container; b) providing a first supply conduit with a first end and a second end, said second end facilitating discharge of at least said first type of blasting particles against a surface to be treated for providing the desired surface treatment thereof; c) metering, via a first metering device, at least said first type of blasting particles from said container into said first end of said supply conduit; and d) pressurizing, via a first pressurizing device, said first end of said supply conduit with a pressurized fluid whereby said pressurized fluid and at least said first type of blasting particles mix with one another in said supply conduit to form a pressurized mixture thereof; e) mixing said second type of blasting particles with said first type of blasting particles and said pressurized fluid prior to the first and second types of particles contacting the surface to be treated, whereby the mixed particles comprise two separate types of blasting particles which facilitates the desired surface treatment of the surface to be treated and reuse of the media.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
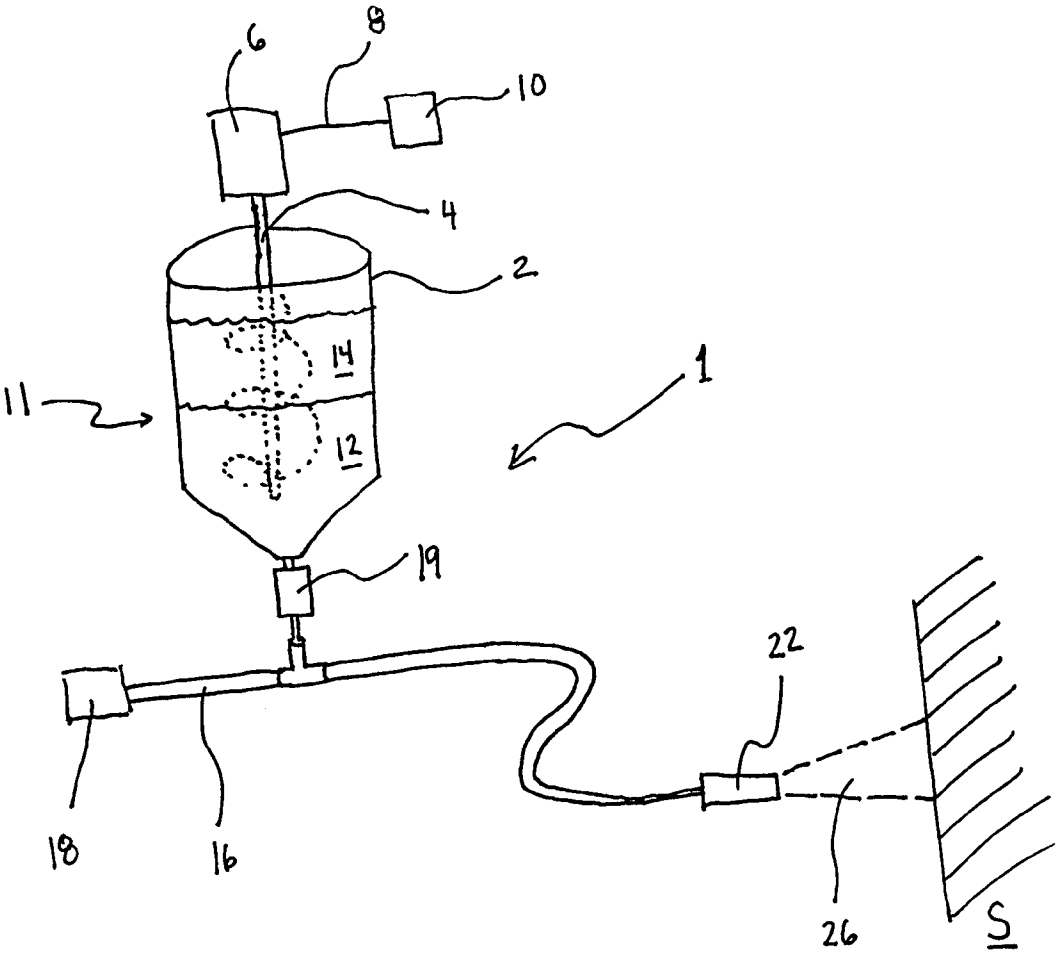
FIG. 1 is a diagrammatic elevational view of a blasting media applicator according to the present invention.

Turning now to FIG. 1, a detailed description concerning the present invention will now be provided. Blasting media applicator, generally designated by reference numeral 1, comprises a tank 2. Mixer or auger 4 is rotatably attached at a first end thereof to motor 6, supported (not shown in detail) above tank 2. Auger 4 is suspended within tank 2 for agitation of the media. Power cable 8 is connected at a first end thereof to motor 6 and at its opposite end to an appropriate power source 10, such as an AC outlet or battery.

Abrasive particles 12 and absorptive particles 14 contained within tank 2 typically have different densities, which leads to separation of the two different types of particles 12, 14 in the blasting equipment during use, i.e. the heavier abrasive particles 12 generally sink toward the bottom of the container while the lighter absorptive particles 14 generally rise toward the top of the container. The mixing action of auger 4 located within tank 2, when motor 6 is operating, completely and uniformly mixes the abrasive particles 12 with the absorptive particles 14, thereby preventing separation of the two components from one another and assists with achieving a substantially uniform supply of blasting media to the surface to be treated. Virtually any known mixing device may be employed as long as it is able to uniformly mix the particles 12, 14 in tank 2. As such feature is well known to those skilled in this art, a further detailed description concerning the same is not provided herein.

The media 11 to be discharged comprises a desired blend of abrasive particles 12 and absorptive particles 14 supplied by tank 2. Abrasive particles 12 may be any one of a variety of known abrasive components, such as corn, plastic, Black Beauty®, black walnut shell grit, sand, garnet or other available abrasive grits, etc., depending upon the application.

Blasting device 20 (designated by the dashed line) comprises tank 2, supply conduit 16, a pressurized air supply source 18, and a conventional metering device or means 19. Supply conduit 16 is connected at a first end thereof to the pressurized air supply source 18 and at a second end thereof to a blasting nozzle 22. Metering device or means 19 is connected at a first end thereof to tank 2 and at a second end thereof to a "tee" provided in the first end of supply conduit 16. Metering device or means 19 may be an auger or any other known positive feed device which will feed and/or meter a desire flow rate of media 11 from tank 2 into air supply conduit 16.

Air supply source 18 provides a stream of pressurized air, e.g. typically at a pressure ranging from about 2 psi to about 100 psi, into supply conduit 16, and media 11, comprising a desired blend of the surface treatment particles, e.g., approximately equal amounts of abrasive particles 12 and absorptive particles 14, is supplied via metering means 19 into supply conduit 16 and conveyed to blasting nozzle 22. Blasting nozzle 22 directs the supplied stream 26, including air and media 11, at a desired surface S to be treated.

Figure 2:
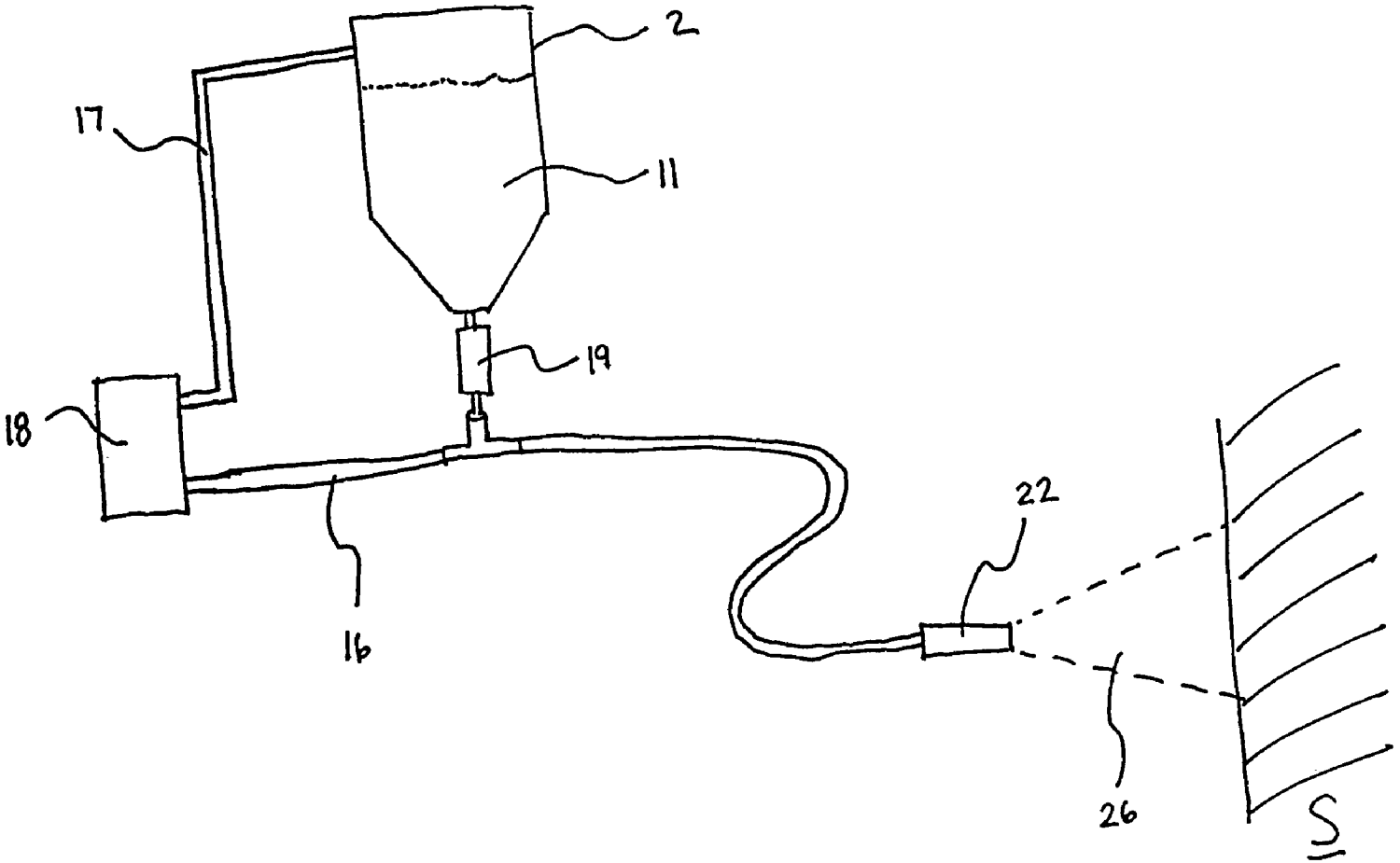
FIG. 2 is a diagrammatic elevational view of a second embodiment of the blasting media applicator according to the present invention.

A second embodiment of the present invention is shown in FIG. 2. Blasting device 20' (designated by the dashed line) comprises supply conduit 16, connected at a first end thereof to a pressurized air supply source 18 and at a second end thereof to a blasting nozzle 22. Metering means 19 is connected at a first end thereof to tank 2, which is a closed container in this embodiment, and at a second end thereof to a "tee" provided in the first end of supply conduit 16. A second pressurizing conduit 17 is connected at a first end thereof to air supply source 18 and at a second end thereof to tank 2 for pressurizing the tank 2 to the same pressure as the remainder of the system.

The air pressure within tank 2, in combination with metering means 19, conveys the mixed and combined media 11 into the pressurized air stream contained within supply conduit 16. The pressurized air conveys media 11 through supply conduit 16 and out through blasting nozzle 22 as stream 26 which is direct toward a surface S to be treated.

It is to be appreciated that metering means 19 may be a variety of different devices, depending upon the application. In the first embodiment, as depicted in FIG. 1, tank 2 is at atmospheric pressure and supply conduit 16 is under a higher pressure due to air supply source 18. Metering means 19, therefore, must be a feeding device which will overcome the pressure in supply conduit 16 and still accurate and positively meter or feed media 11 from tank 2 into supply conduit 16 at a desired flow rate, e.g. linear flow rate. In the second embodiment, as depicted in FIG. 2, as tank 2 and supply conduit 16 are both pressurized substantially equally, metering means 19 may be a somewhat simplified feed device, such as a screw conveyor or an auger, which will feed media 11 in at a desired flow rate, e.g. linear flow rate, into supply conduit 16.

Figure 3B:
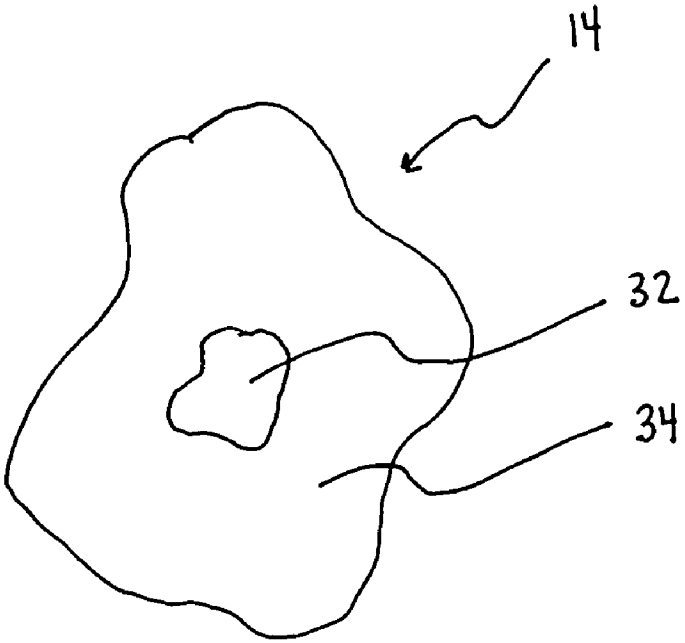
FIGS. 3A and 3B are diagrammatic cross-sectional views of second variations of the blasting particles according to FIG. 1.
Figure 3A:
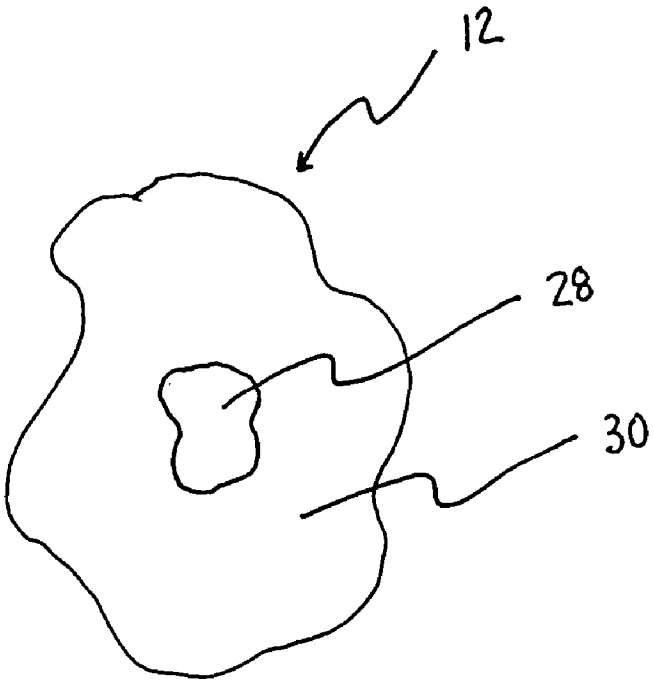

According to a second embodiment of media 11, as shown in FIGS. 3A and 3B, abrasive particle 12 (FIG. 3A), for example, comprises a central core 28 surrounded or encapsulated by an abrasive component 30, for example. Absorptive particle 14 (FIG. 3B), for example, comprises a central core 32 surrounded or encapsulated by an absorptive component 34, for example. Abrasive particles 12 and absorptive particles 14 are formed by applying a resin, polymer, glue or other suitable bonding agent to an exterior surface of cores 28, 32, and then applying the abrasive component 30 and the absorptive component 34, respectively, to the resin, polymer, glue or other suitable bonding agent coated on the exterior surface of cores 28, 30 in a conventional manner, e.g. mixing, sprinkling, etc.

As the density of abrasive component 30 is generally greater than that of the absorptive component 34, the density of core 32, for the absorptive component 34, is therefore selected to be greater in density than the density of core 28, for the abrasive component 30, so that the formed abrasive particle 12 and absorptive particle 14 have approximately the same or closely similar weight for particles of equal size. Core 28 may be, for example, a rubber core while core 32 may be, for example, a plastic core. Both cores 28, 32 may be any suitable material which allows the abrasive, absorptive, polishing, or other surface finishing or treating components to adhere to the exterior surface of the cores 28, 32 and provides a particle of a desired density.

Forming media 11 from a stream of particles having approximately equal amounts of abrasive particles 12 and absorptive particles 14 facilitates blasting. Since abrasive particles 12 and absorptive particles 14 have approximately equal weights, due to their cores 28, 32 having different densities, continuous use of mixer or auger 4 in tank 2 is generally not necessary, once the media is uniformly mixed, in order to ensure that the mixed media 11 supplied to supply conduit 16 comprises the appropriate proportion of each type of particles, e.g. a 50-50 media blend, 60-40 media blend, a 75-25 media blend, a 25-35-45 blend, etc.

During a blasting operation, the abrasive component 30, of the abrasive particle 12, removes material from the surface being treated by a rubbing and/or friction action which typically wears the abrasive component 30 from the exterior surface of core 28 and, over prolonged use, may eventually lead to exposure of core 28. Once this occurs, abrasive particle 12 has lost its surface treatment effectiveness. It is to be appreciated, however, that core 28 is selected so as not to wear during use and thus it is substantially completely recyclable and can be recoated with abrasive component 30 and reused. This recoating will result in a substantial reduction in the cost of using media 11 and minimize disposal of any generated waste.

Any contaminants on core 28 will be located on the exterior surface thereof and this facilitates easy cleaning of the surface prior to recoating of core 28. In known prior art composite particles, which combine absorptive and abrasive components with one another in the same particle, the contaminants are absorbed by the absorptive component of the particle, which does not facilitate easy cleaning of the media and may lead to premature disposal or cleaning of the media being used to prevent the absorptive component of the media from recontaminating the surface being cleaned during subsequent use.

Figure 4B:
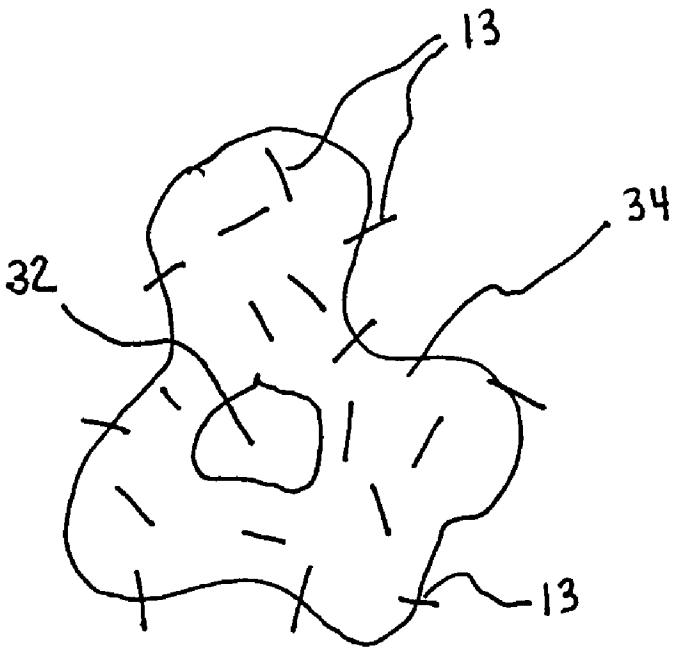
FIGS. 4A and 4B are diagrammatic cross-sectional views of third variations of the blasting particles according to FIG. 1.
Figure 4A:
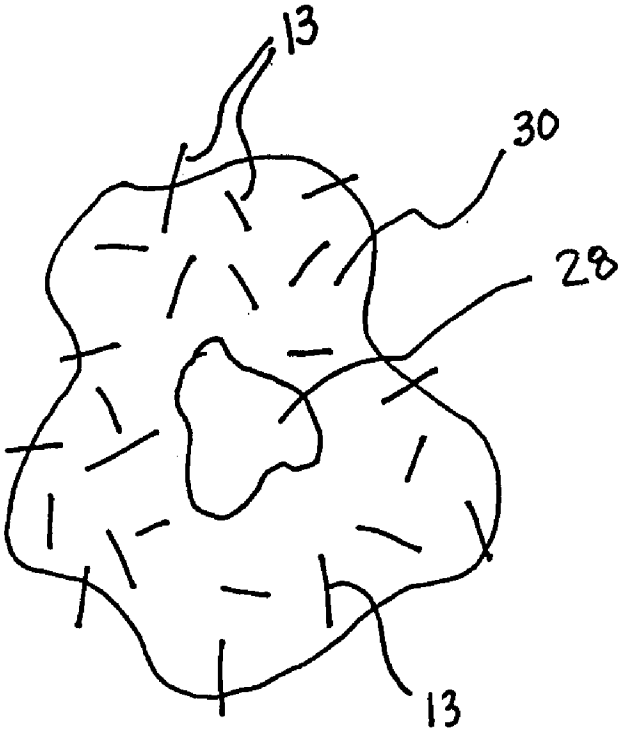

A third embodiment of media 11 is shown in FIGS. 4A and 4B. According to this embodiment, a plurality of small fibers 13, such as nylon fibers, are added to abrasive component 30 and absorptive component 34 during coating of cores 28 and 32. Some of the fibers 13 are completely imbedded within the abrasive component 30 and absorptive component 34, while a portion of others of the fibers 13 partially project from the exterior surface of abrasive particles 12 and absorptive particles 14. The portions of fibers 13 partially projecting from the exterior surface of these particles intermingle with fibers of adjacent particles, thereby assisting with preventing separation of the different particles 12, 14 from one another if mixing of the media is discontinued. Cores 28, 32 are selected to have a size preferably between a #10 screen and a #30 screen.

In order to increase the speed of the blasting operation, abrasive particles 12 and absorptive particles 14 may be made relatively small, e.g. between 1/100 and 1/8 inches. The abrasive particles 12 and the absorptive particles 14 may also be agglomerated to increase their effective size and thereby enhance mechanical separation and/or facilitate recovery of the media.

Figure 5:
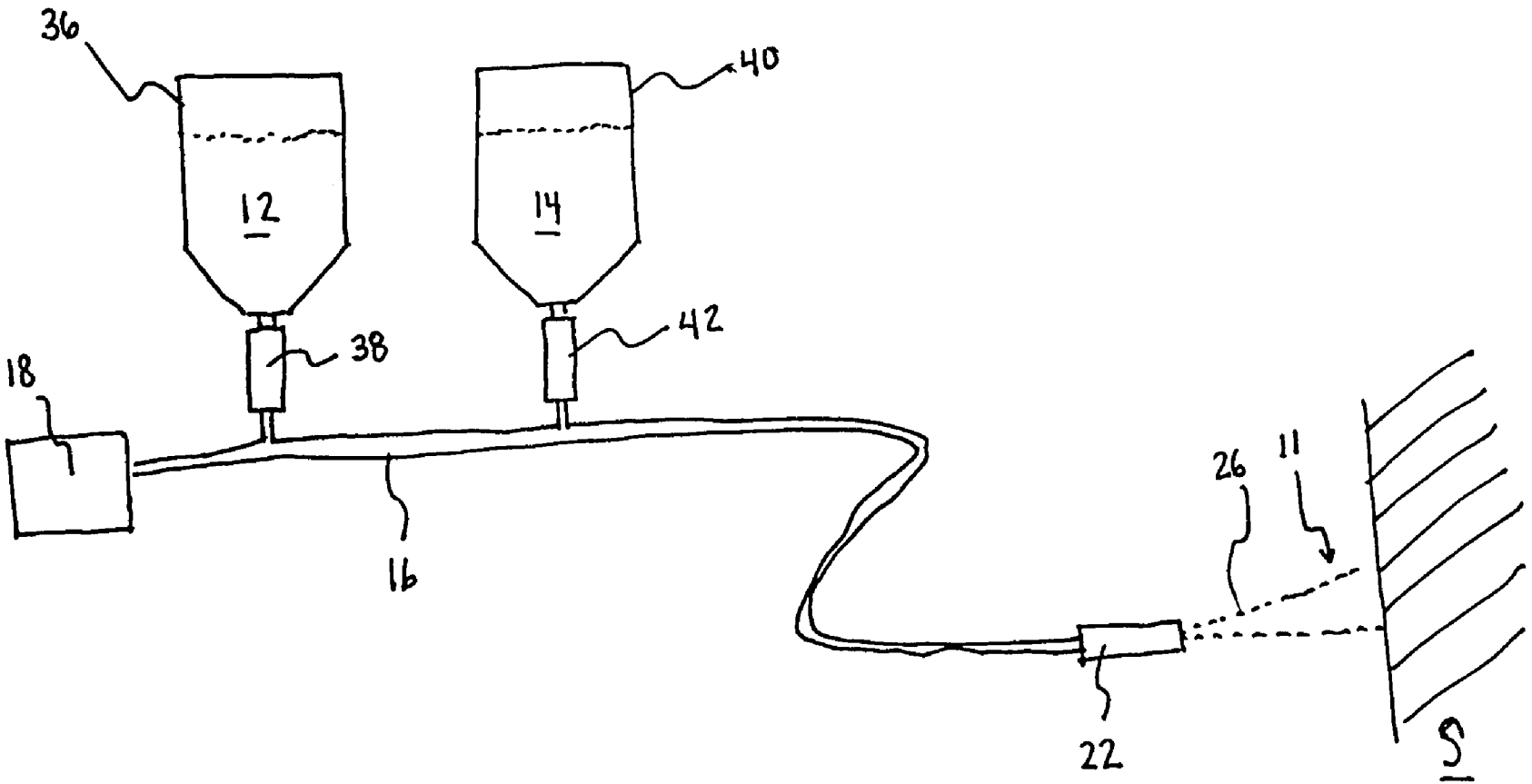
FIG. 5 is a diagrammatic elevational view of a third embodiment of the blasting media applicator according to the present invention.

Turning now to FIG. 5, a third embodiment of the invention is shown. Blasting media applicator 1' comprises two separate containers, i.e. container 36 which contains a first type or kind of particles, e.g. abrasive particles 12, and container 40 which contains a second type or kind of particles, e.g. absorptive particles 14, for example. Supply conduit 16 is connected at a first end thereof to the pressurized air supply source 18 and at a second end thereof to the blasting nozzle 22. Metering device or means 38 is connected at a first end thereof to container 36 and at a second end thereof to air supply conduit 16. Metering device or means 42 is connected at a first end thereof to container 40 and at a second end thereof to air supply conduit 16. Stream 26, comprising media 11 of both types of particles 12, 14 and pressurized air, is supplied to and directed by blasting nozzle 22 at the surface S to be cleaned.

Figure 6B:
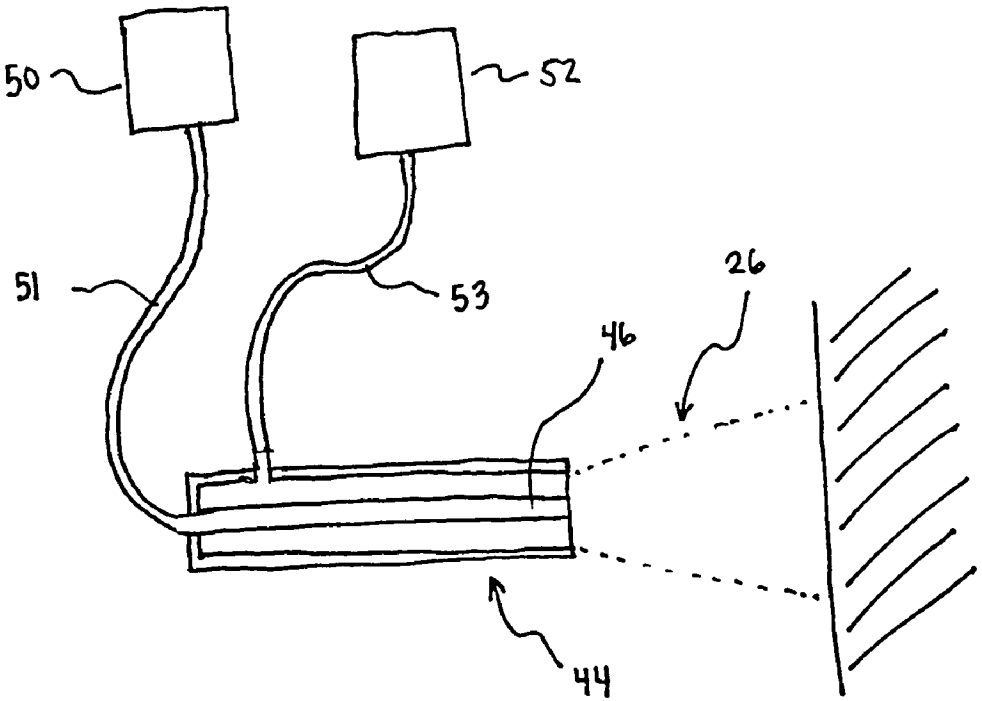
FIG. 6B is a diagrammatic cross-sectional view of the nozzle according to FIG. 6A.
Figure 6A:
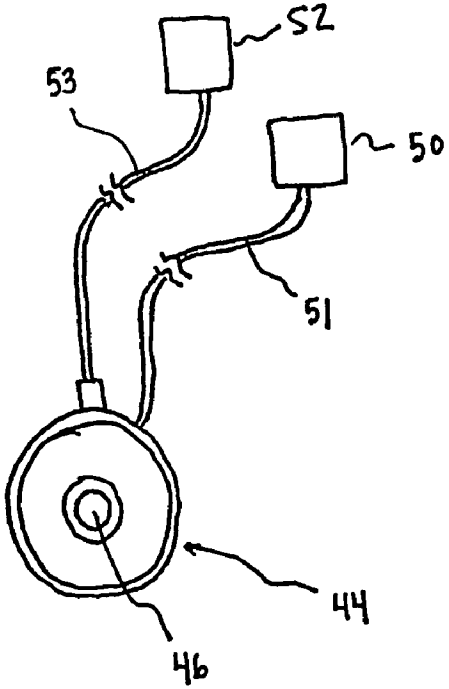
FIG. 6A is a diagrammatic end view of a second embodiment of a blasting nozzle.

A second embodiment of the blasting nozzle, as well as the manner in which the media is supplied thereto, is shown in FIGS. 6A and 6B. Blasting nozzle 44 is provided with a central discharge opening 46 located in a central portion of a discharge end face of nozzle 44. In addition, a ring or annular discharge opening 48 is provided in an outer portion of the discharge end face of nozzle 44. Central discharge opening 46 is supplied with a first type or kind of blasting particles, e.g. abrasive particles 12, via a container, metering means, and air supply source only generally designated as 50, conveyed to an end inlet of nozzle 44 via supply conduit 51, while annular discharge opening 48 is supplied with a second type or kind of blasting particles, e.g. absorptive particles 14, via a container, metering means, and air supply source only generally designated as 52, conveyed to a side inlet of nozzle 44 via supply conduit 53. During use, the two kinds of particles mix with one another so that the resultant stream 26 comprises a mixed media, i.e. mixture of abrasive particles 12 and absorptive particles 14. Stream 26 is directed at the surface to be treated S where the particles 12, 14 provide the desired surface treatment.

Figure 7:
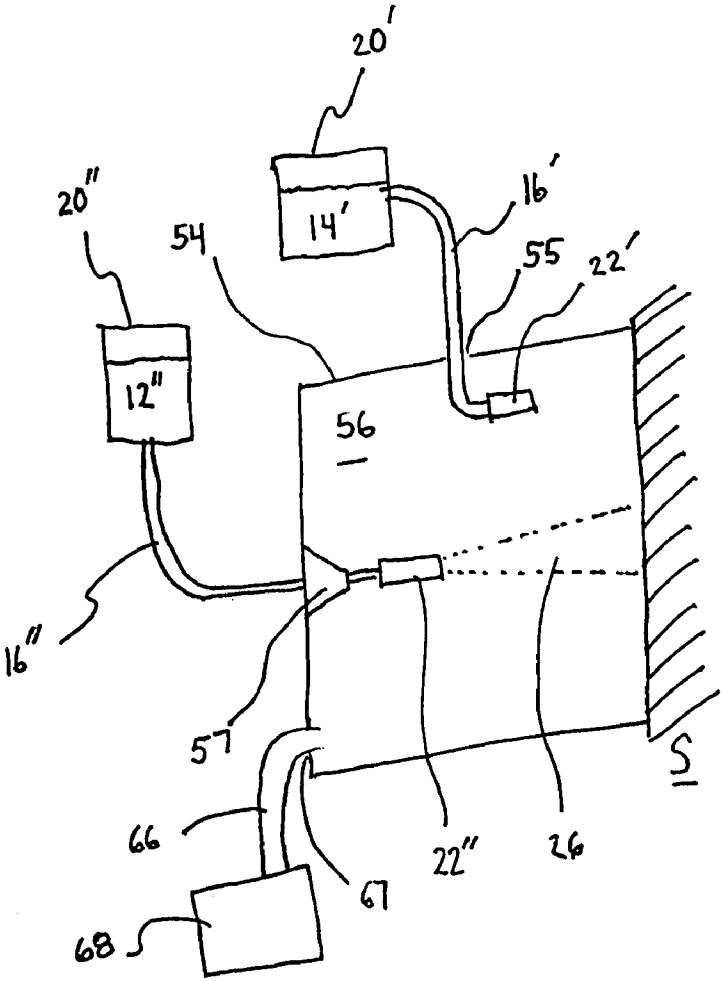
FIG. 7 is a diagrammatic elevational view of a fourth embodiment of the blasting media applicator according to the present invention showing a containment barrier and a surface to be treated in cross section.

A fourth embodiment of the present invention is shown in FIG. 7. According to this embodiment, blasting device 20' is connected to a first end of a supply conduit 16' while the opposite end of supply conduit 16' is connected to a discharge nozzle 22'. The blasting device 20' contains and supplies absorptive particles 14'. Discharge nozzle 22' extends through an aperture 55 provided in an upper portion of containment barrier 54. Containment barrier 54 surrounds and seals containment area 56 around surface S, which is to be treated. Absorptive particles 14' are projected by blasting device 20' into containment area 56 and are at least partially suspended therein.

Containment barrier 54 is more fully described in U.S. Pat. No. 5,823,860 issued on Oct. 20, 1998 and the subject matter of that patent is incorporated herein by reference.

Blasting device 20" is connected to a first end of a supply conduit 16" while the opposite end of supply conduit 16" is connected to a discharge nozzle 22". The blasting device 20" contains and supplies abrasive particles 12". Discharge nozzle 22" extends through an access port 57 provided in the containment barrier 54, e.g. in a central portion of containment barrier 54. Access port 57 is typically a flexible conical shaped member which allows nozzle 22" to be pivoted at least about 900, relative to a central axis of the access port 57, while also facilitating rotation, within containment area 56, of about 360° so that the entire surface S can be treated.

During use, abrasive particles 12" are supplied by blasting device 20" into containment area 56 which contains absorptive particles 14' at least partially suspended in containment area 56. The partial suspension of absorptive particles 14' is enhanced by the turbulence created within containment area 56 by the air streams projected by blasting devices 20', 20" and by the rebounding of media 11 off the surface S and the surfaces of containment barrier 54.

Abrasive particles 12" in the stream 26 are therefore mixed with the "suspended" absorptive particles 14', and the abrasive particles 12" contact, mix and carry therewith the "suspended" absorptive particles 14' and form a combined media 11 which is conveyed toward the surface S and achieves the desired surface treatment thereof.

Exhaust hose 66 is attached, at a first end thereof, to an outlet 67 provided in a lower portion of containment barrier 54. A second end of exhaust hose 66 is connected to an inlet of a vacuum pump or other suction device 68, for example a Dust Collector manufactured by IPEC Inc. of Rhode Island, U.S.A. The exhaust hose 66 and the suction device 68 create a negative pressure within containment area 56, during use of the system, which removes airborne media and dust, any excess applied media, removed substance, material, contaminants, debris, etc. from containment area 56. This negative pressure reduces the opportunity for media 11 and/or contaminants to escape from containment area 56 into the surrounding area by any crack or other opening in the containment barrier 54 so that the only available exhaust flow path is via exhaust hose 66.

During use, the media 11 of all four embodiments is supplied by suitable blasting or propelled means. Typically, the media 11 is conveyed by compressed air, or some other pressurized fluid such as water, or by known mechanical conveying means, against surface S which is to be treated. Media 11 then rebounds off the surface S and is collected and recovered by suction device 68. Any contaminated absorptive particles which are collected can be separated and removed from the media for cleaning and subsequent reuse, or properly disposed of once the absorptive particles are fully contaminated and not recyclable. The abrasive component and/or any contaminants can also be separated and removed from the reusable media for proper disposal.

By forming the media 11 from at least two separate and distinct types of particles, an operator is able to custom blend the media during use to achieve maximum surface treatment per pound of media. For example, if a first area of the surface to be treated requires substantial rust removal, the abrasive portion of the media 11 can be increased to facilitate such rust removal. Once that area is adequately treated, the operator can lower the proportion of the abrasive component of the media 11 and increase the proportion of the absorptive composition of the media, for example, to facilitate adequate grease or oil removal from another area of the surface S to be treated.

It is to be appreciated that the media 11 may be formed of more than two distinct types or kinds of particles. When more than two types of particles are employed, more than two containers may be necessary, e.g. three, four or more separate containers may be required depending upon the application. Each of these containers would typically contain a different type of particle, which would then be mixed together forming media 11 to be applied to a surface S to be treated. The metering means of feed device for each container may be separately controlled (not shown in detail) so that the desired amount of each proportion of each particle type is easily obtainable and readily variable.

The ability of an operator to custom blend the media, during use while at a jobsite, maximizes treatment of the surface per pound of media and minimizes the generation of waste which have to be disposed of as a result of the surface treatment.

Since certain changes may be made in the above described media and blasting system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A blasting media system comprising at least first and second types of different blasting particles, the system comprising:

a) a first container containing a supply of at least the first type of blasting particles;

b) a first supply conduit having a first end and a second end, the second end facilitating discharge of at least the first type of blasting particles against a surface to be treated for providing a desired surface treatment thereof;

c) a first metering device for metering at least the first type of blasting particles from the container into the first end of the supply conduit; and d) a first device for pressurizing the first end of the supply conduit with a pressurized fluid whereby the pressurized fluid and at least the first type of blasting particles mix with one another in the supply conduit to form a pressurized mixture thereof;

wherein the second type of blasting particles is mixed with the first type of blasting particles and the pressurized fluid, prior to the first and the second types of particles contacting the surface to be treated, whereby the first and second mixed particles comprise two separate types of blasting particles which facilitates the desired surface treatment of the surface to be treated and reuse of the first and the second types of particles;

a blasting nozzle is secured to the second end of the supply conduit for directing the mixed first and second types of particles against the surface to be cleaned; and the second type of blasting particles is mixed with the first type of blasting particles in the first container and supplied together into the supply conduit by the first metering device.

2. A blasting media system according to claim 1, wherein the second type of blasting particles are contained within a second container and a second metering device is connected to the first end of the supply conduit, and the first type of blasting particles and the second type of blasting particles are mixed with one another and the pressurized fluid in the supply conduit.

3. A blasting media system comprising at least first and second types of different blasting particles, the system comprising:

a) a first container containing a supply of at least the first type of blasting particles;

b) a first supply conduit having a first end and a second end, the second end facilitating discharge of at least the first type of blasting particles against a surface to be treated for providing a desired surface treatment thereof;

c) a first metering device for metering at least the first type of blasting particles from the container into the first end of the supply conduit; and d) a first device for pressurizing the first end of the supply conduit with a pressurized fluid whereby the pressurized fluid and at least the first type of blasting particles mix with one another in the supply conduit to form a pressurized mixture thereof;

wherein the second type of blasting particles is mixed with the first type of blasting particles and the pressurized fluid, prior to the first and the second types of particles contacting the surface to be treated, whereby the first and second mixed particles comprise two separate types of blasting particles which facilitates the desired surface treatment of the surface to be treated and reuse of the first and the second types of particles;

a blasting nozzle is secured to the second end of the supply conduit for directing the mixed first and second types of particles against the surface to be cleaned; and the blasting nozzle comprises a central discharge opening located in a central discharge end of the blasting nozzle and an annular discharge opening surrounds the central discharge opening; and the second end of the supply conduit communicates with the central discharge opening; and the second type of blasting particles are contained within a second container and a second metering device is connected to and supplies the second type of blasting particles to the annular discharge opening, and the first type of blasting particles and the second type of blasting particles are mixed with one another during discharge.

4. A blasting media system comprising at least first and second types of different blasting particles, the system comprising:

a) a first container containing a supply of at least the first type of blasting particles;

b) a first supply conduit having a first end and a second end, the second end facilitating discharge of at least the first type of blasting particles against a surface to be treated for providing a desired surface treatment thereof;

c) a first metering device for metering at least the first type of blasting particles from the container into the first end of the supply conduit; and d) a first device for pressurizing the first end of the supply conduit with a pressurized fluid whereby the pressurized fluid and at least the first type of blasting particles mix with one another in the supply conduit to form a pressurized mixture thereof;

wherein the second type of blasting particles is mixed with the first type of blasting particles and the pressurized fluid, prior to the first and the second types of particles contacting the surface to be treated, whereby the first and second mixed particles comprise two separate types of blasting particles which facilitates the desired surface treatment of the surface to be treated and reuse of the first and the second types of particles;

a blasting nozzle is secured to the second end of the supply conduit for directing the mixed first and second types of particles against the surface to be cleaned; and the system further comprising:

a) a second container containing a supply of at least the second type of blasting particles;

b) a second supply conduit having a first end and a second end, the second end facilitating discharge of at least the second type of blasting particles;

c) a second metering device for metering at least the second type of blasting particles from the container into the first end of the second supply conduit; and d) a second device for pressurizing the first end of the second supply conduit with a pressurized fluid whereby the pressurized fluid and at least the second type of blasting particles are mixed with one another in the supply conduit to form a pressurized mixture thereof; and e) the second type of blasting particles are mixed with the first type of blasting particles just prior to the combined first and second type of blasting particles contacting the surface to be treated.

* * * * *